US008911261B2

(12) United States Patent
Liao

(10) Patent No.: US 8,911,261 B2
(45) Date of Patent: Dec. 16, 2014

(54) BIDIRECTIONAL CONNECTOR WITH MOVABLE CIRCUIT UNIT

(71) Applicant: Sheng-Hsin Liao, New Taipei (TW)

(72) Inventor: Sheng-Hsin Liao, New Taipei (TW)

( * ) Notice: Subject to any disclaimer, the term of this patent is extended or adjusted under 35 U.S.C. 154(b) by 155 days.

(21) Appl. No.: 13/756,607

(22) Filed: Feb. 1, 2013

(65) Prior Publication Data

US 2014/0148063 A1 May 29, 2014

(30) Foreign Application Priority Data

Nov. 26, 2012 (TW) ..... 101144104 A

(51) Int. Cl.

| | |
|---|---|
| ***H01R 24/00*** | (2011.01) |
| ***H01R 33/00*** | (2006.01) |
| ***H01R 13/66*** | (2006.01) |
| ***H01R 24/62*** | (2011.01) |
| ***H01R 29/00*** | (2006.01) |

(52) U.S. Cl.

CPC ..... *H01R 13/6658* (2013.01); *H01R 24/62* (2013.01); *H01R 29/00* (2013.01)

USPC ..... 439/660

(58) Field of Classification Search

USPC ..... 439/660, 170, 171, 172, 173, 174, 955

See application file for complete search history.

(56) References Cited

U.S. PATENT DOCUMENTS

| | | | | |
|---|---|---|---|---|
| 4,420,216 | A * | 12/1983 | Motoyama et al. | 439/188 |
| 6,109,943 | A * | 8/2000 | Arnett | 439/189 |
| 6,139,343 | A * | 10/2000 | Arnett | 439/188 |
| 6,480,390 | B2 * | 11/2002 | Matsumiya et al. | 361/736 |
| 7,037,120 | B1 * | 5/2006 | Yeh | 439/131 |
| 7,727,029 | B2 * | 6/2010 | Bolin et al. | 439/669 |

* cited by examiner

*Primary Examiner* — Hae Moon Hyeon

(74) *Attorney, Agent, or Firm* — Li & Cai Intellectual Property (USA) Office

(57) ABSTRACT

A bidirectional connector includes a hollow insulating main body, a plurality of first conductive terminals, a plurality of second conductive terminals and a circuit unit which is movably disposed within the insulating main body. The circuit unit has a circuit board that has a top face and a bottom face. The top face has a plurality of first contacts and a plurality of second contacts and the first contacts are arranged in alternative routing. Each of the first conductive terminals has a first contact portion and a second contact portion. The second contact portion selectively contacting the first and second contacts.

13 Claims, 8 Drawing Sheets

BIDIRECTIONAL CONNECTOR WITH MOVABLE CIRCUIT UNIT

BACKGROUND

1. Field of the Invention

The instant disclosure relates to a connector; in particular, to a bidirectional connector.

2. Description of Related Art

Connectors electrically connect to cables, circuit boards and other electronic components. They are in common use with a great variety of electronic device such as cell phone, tablet, laptop and personal digital assistance (PDA). A conventional connector includes an insulating main body and conductive terminals mounted thereon. Upon insertion, the plug can only successfully mate the receptacle by a given orientation. Otherwise the plug cannot fittingly match the receptacle and the insertion fails accordingly.

SUMMARY OF THE INVENTION

The object of the instant disclosure is to provide a bidirectional connector in an attempt to facilitate the insertion process.

Another object of the instant disclosure is to provide a connector device which allows contact pin switching.

According to one exemplary embodiment of the instant disclosure, the bidirectional connector includes a hollow insulating main body, a plurality of first conductive terminals, a plurality of second conductive terminals and a circuit unit. The insulating main body has a first face and a second face. The first conductive terminals are mounted on the insulating main body. Each of the first conductive terminals has a first contact portion exposed on the first face, a second contact portion bulging toward the interior of the insulating main body, and a first connection portion. Likewise, the second conductive terminals are mounted on the insulating main body. Each of the second conductive terminals has a third contact portion exposed on the second face, and a second connection portion. The circuit unit is movably disposed within the insulating main body and has a top face and a bottom face. The top face has a plurality of first contacts and a plurality of second contacts. The traces of the first contacts are routed alternatively and the second contact portion selectively contacts the first and second contacts.

In summary, the alternative routing of the contacts and the movable circuit unit within the insulating main body collectively allow bidirectional orientation upon insertion. The movable circuit unit also allows contact pin switching in an attempt to facilitate insertion process.

In order to further understand the instant disclosure, the following embodiments are provided along with illustrations to facilitate the appreciation of the instant disclosure; however, the appended drawings are merely provided for reference and illustration, without any intention to be used for limiting the scope of the instant disclosure.

DETAILED DESCRIPTION OF THE PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

Figure 1:
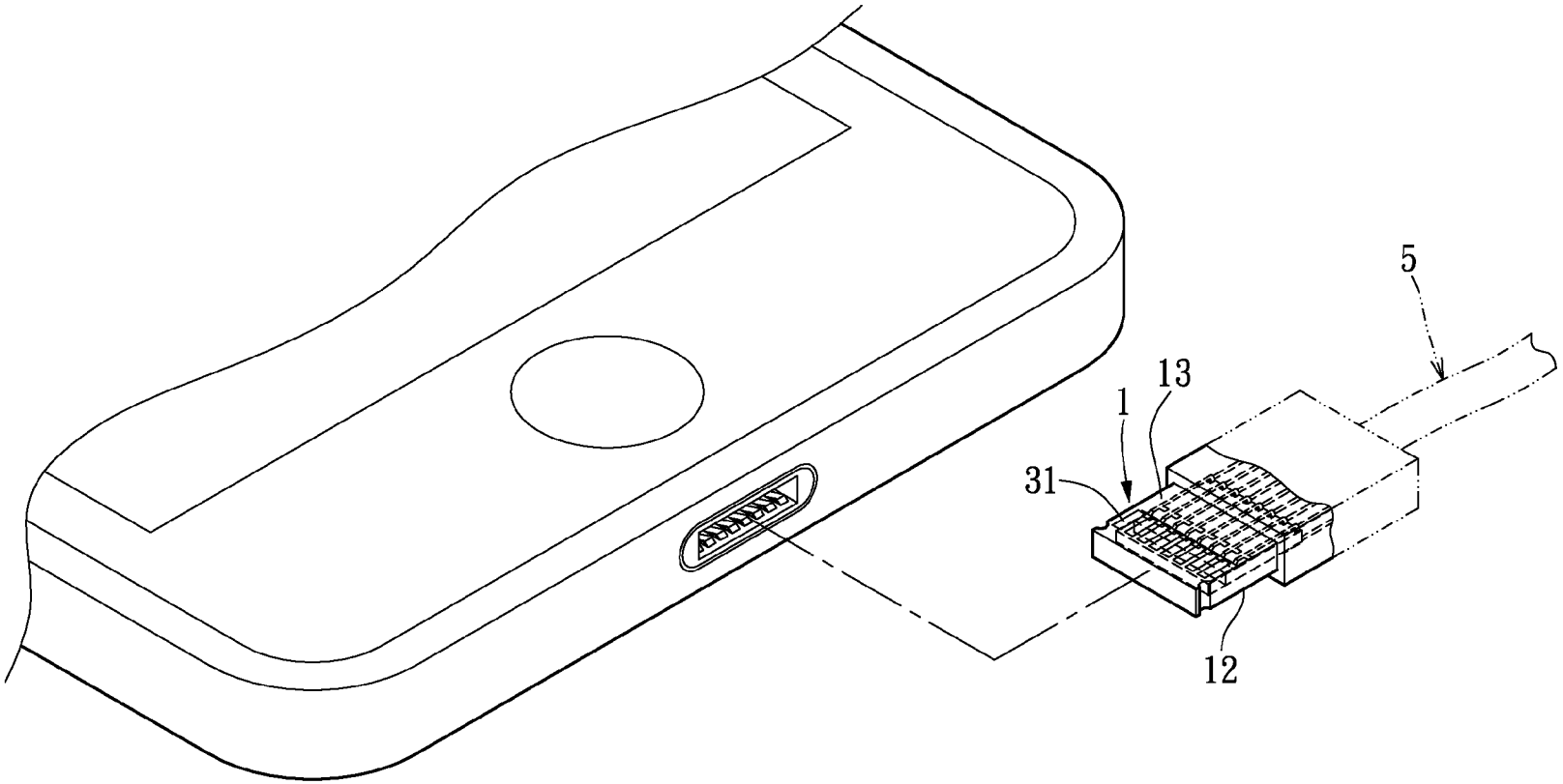
FIG. 1 illustrates a perspective view of a connector in accordance with a first embodiment of the instant disclosure.
Figure 2:
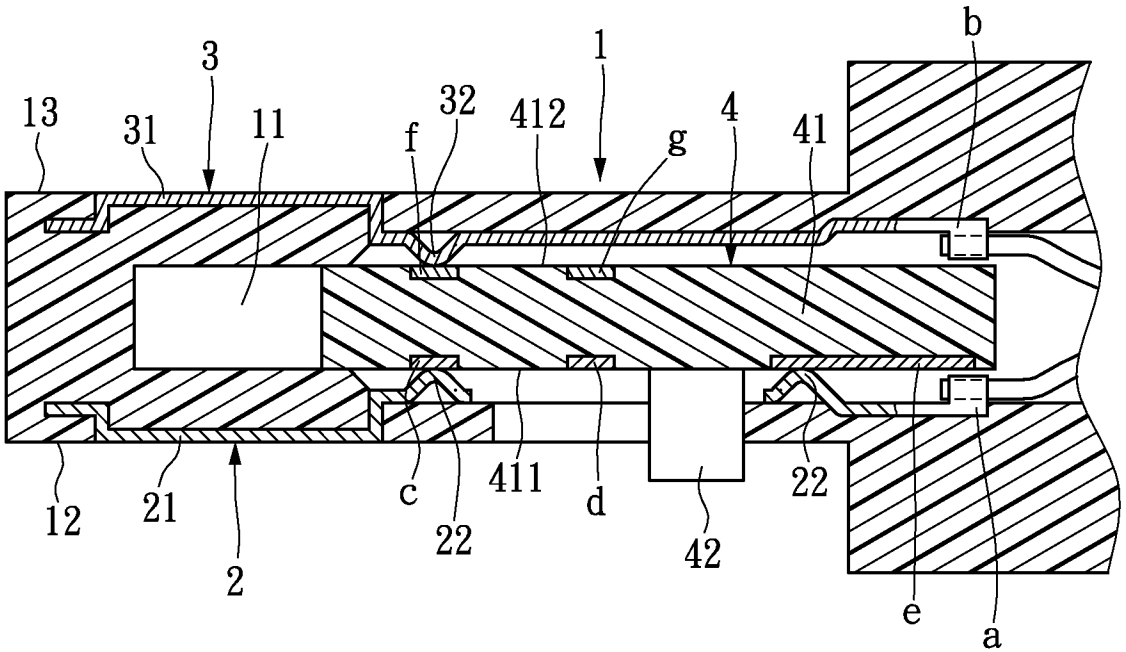
FIG. 2 illustrates a cross-sectional view of a connector in accordance with a first embodiment of the instant disclosure.
Figure 3:
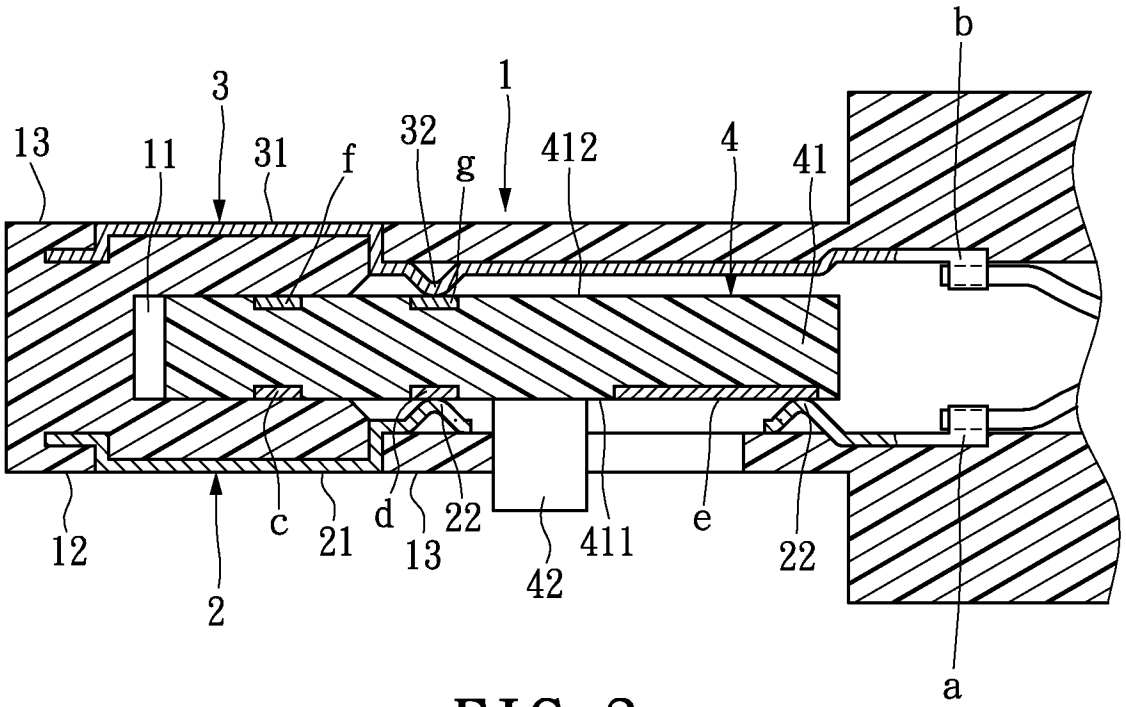
FIG. 3 illustrates a cross-sectional view of a connector in another state in accordance with a first embodiment of the instant disclosure.
Figure 7:
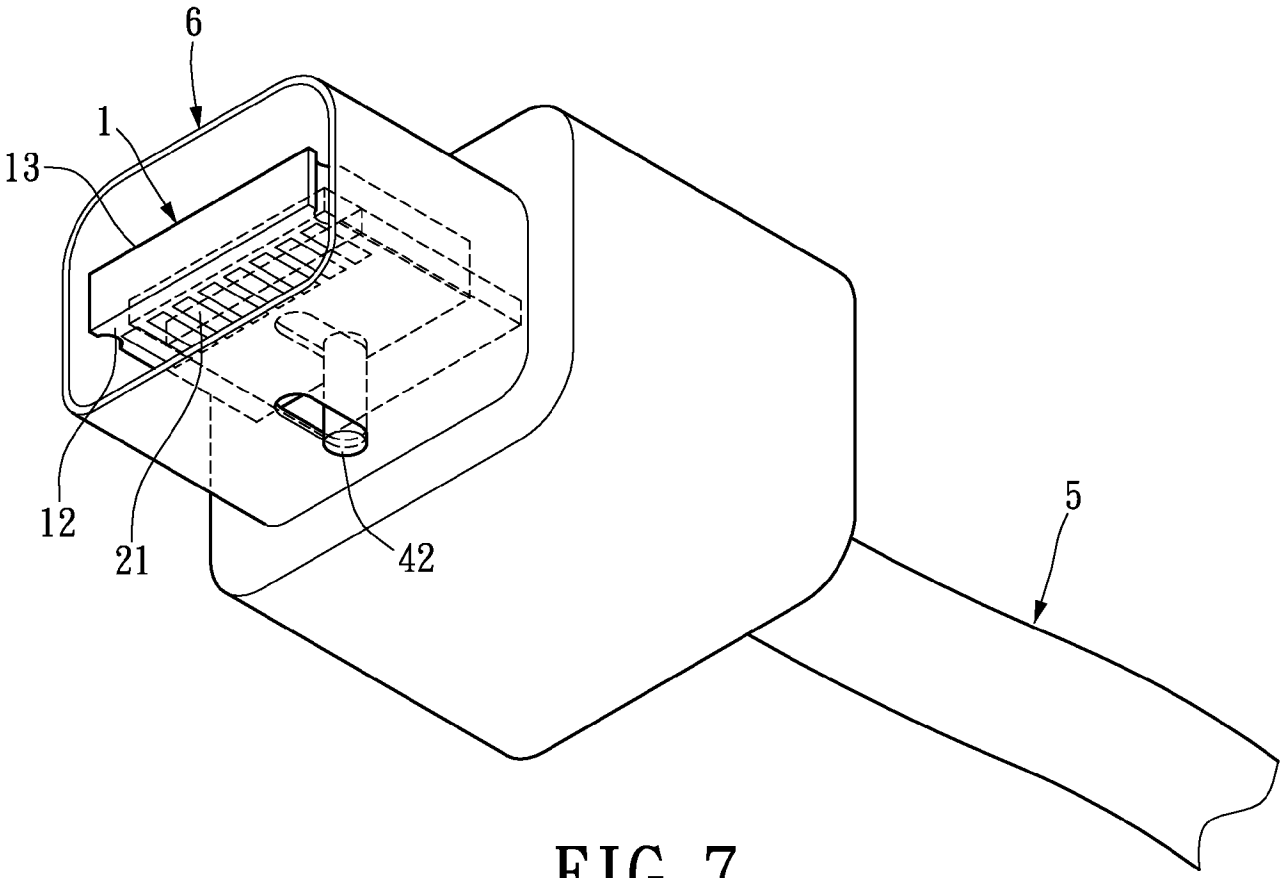
FIG. 7 illustrates a perspective view of a connector in accordance with a third embodiment of the instant disclosure.

Attention now is invited to FIGS. 1~3. The instant disclosure provides a connector, which includes a hollow insulating main body 1, a plurality of first conductive terminals 2, a plurality of second conductive terminals 3 and a circuit unit 4. The insulating main body 1 is made of plastic or other insulating materials. The insulating main body 1 may be a one piece structure or a combination multiple pieces. The insulating main body 1 is hollow so as to receive circuit unit 4 therein. The insulating main body 1 has a cavity 11, a first face 12, and a second face 13. The first and second faces 12, 13 are opposite outer faces of the insulating main body 1. The shape and structure of the insulating main body 1 can vary according to different requirements. The insulating main body 1 can also be coated with a metallic shell 6 (as shown in FIG. 7).

The first and second conductive terminals 2, 3 are made of highly conductive metallic materials and mounted on the insulating main body 1. In the instant embodiment the first and second conductive terminals 2, 3 are insert moldings on the insulating main body 1 but the mounting method is not limited thereto. The shape and structure of the first and second conductive terminals 2, 3 can vary according to different requirements.

Each of the first conductive terminals 2 has a first contact portion 21 and a second contact portion 22. The first contact portion 21 is exposed on the first face 12 of the insulating main body 1 in a row so as to permit electrical connection. The second contact portion 22 extends from one end of the first contact portion 21 while the other end thereof bulges toward the cavity of the insulating main body 1 for electrical connection with the circuit board unit 4.

Each of the second conductive terminals 3 is formed with a third contact portion 31 and a fourth contact portion 32. The third contact portion 31 is exposed on the second face 13 of the insulating main body 1 in a row so as to permit electrical connection. The third contact portion 31 and the first contact portion 21 are positioned opposite to each other within the insulating main body 1. The fourth contact portion 32 extends from one end of the third contact portion 31 while the other end thereof bulges slightly toward the cavity of the insulating main body 1. The fourth and second contact portions 32, 22 do not have to be exactly aligned to each other. In the instant embodiment, the fourth and second contact portions 32, 22 are opposite to each other within the insulating main body 1. However, the fourth contact portion 32 of the second conductive terminals 3 and the second contact portion 22 of the first conductive terminal 2 can be disposed alternatively. The circuit unit 4 is inserted between the fourth and second contact portions 32, 22 and electrical connection is permitted thereamong. In other words, the first and second conductive terminals 2, 3 electrically connect to the circuit unit 4.

Each of the first conductive terminals 2 can have two second contact portions 22 (as shown in FIGS. 2 and 3) and each of the second conductive terminals 3 may have two fourth contact portions 32 (not shown). Turning now to FIGS. 2 and 3, each of the first conductive terminals 2 has two contact portions 22. The two contact portions 22 are arranged discretely yet electrically connect to each other via the circuit unit 4. Similarly, if each of the second conductive terminals 3 has two fourth contact portions 32, the two fourth contact portions 32 can be discretely arranged and electrically connect to each other via the circuit board 4. However, the arrangement and quantity of the second contact portions 22 of the first conductive terminals 2 and the fourth contact portions 32 of the second conductive terminals 3 are not limited by the instant embodiment.

Each of the first conductive terminals 2 has a first connection portion a while each of the second conductive terminals 3 has a second connection portion b. The connection portion a connects the back end of the first conductive terminal 2. Likewise the connection portion b connects the back end of the second conductive terminal 3. The first and second connection portions a, b are useful for electrical connection with an electronic device 5 such as cable or circuit board so the connector is electrically connected to the electronic device 5.

Figure 6:
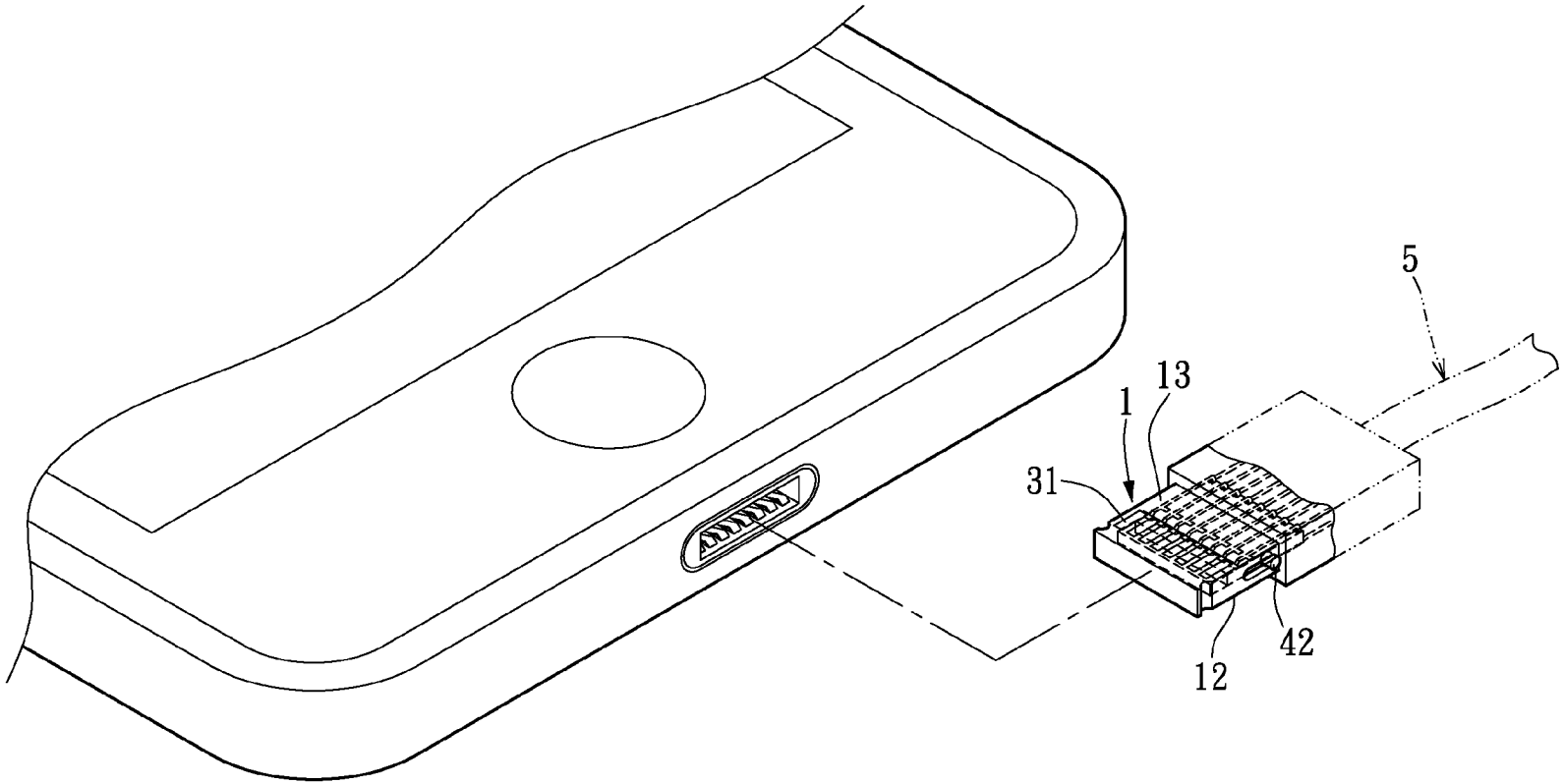
FIG. 6 illustrates a perspective view of a connector in accordance with a second embodiment of the instant disclosure.

The circuit unit 4 is movably disposed within the insulating main body 1, such that the mobility of the circuit unit 4 allows contact pin switching. The circuit unit 4 has a circuit board 41 which has a top face 411 and an opposite bottom face 412. The circuit board 41 can be multi-layered and the surface as well as the interior thereof contains circuit traces. The top face 411 of the circuit board 41 may have a plurality of first contacts c and a plurality of second contacts d. Furthermore, the top face 411 may have a plurality of third contacts e and the first, second and third contacts c, d, e are in separate rows. The contacts are at different locations on the top face 411 with predetermined intervals there-between. The bottom face 412 of the circuit board 41 may have a plurality of fourth contacts f and a plurality of fifth contacts g. The fourth and fifth contacts f, g are in separate rows and positioned at different locations at predetermined intervals. However, the quantity of the contacts is not limited to the instant embodiment. The circuit board 41 may also have a slide button 42 which facilitates the circuit unit 4 to slide within the insulating main body 1. The slide button 42 can penetrate the bottom wall of the insulating main body 1 (as shown in FIGS. 2, 3 and 7), top or side thereof (as shown in FIG. 6).

The first, second, third, fourth and fifth contacts c, d, e, f, g can be alternative routing, corresponding routing or partially alternative routing in order to satisfy different requirements. If the contacts adapt the corresponding routing, the connector can only be inserted by normal orientation. On the other hand, if the contacts adapt alternative routing, the connector can successfully mate with normal and inverted orientations. In the instant embodiment, the first and fourth contacts c, f are alternative routing while the second and fifth contacts d, g are open to different arrangements. By modifying the circuit board 41, the traces of routing may vary so as to allow various connection modes.

Figure 5:
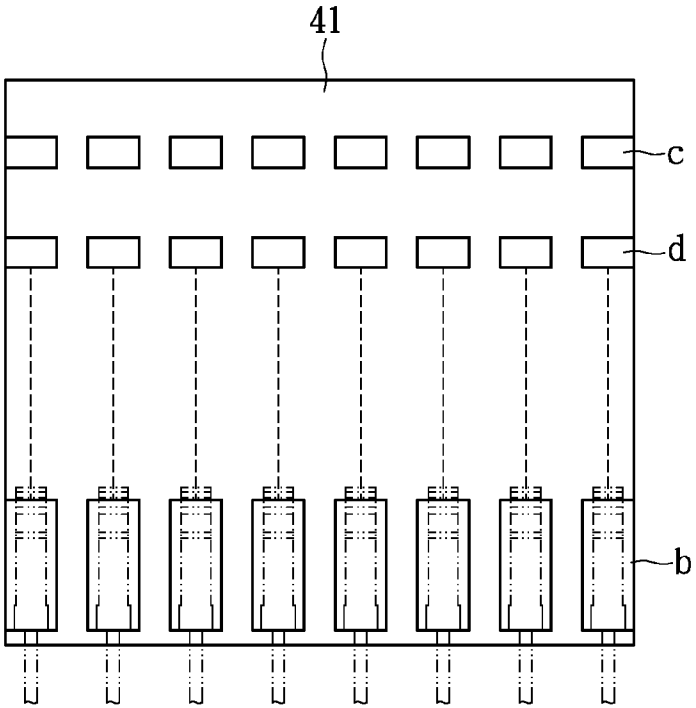
FIG. 5 illustrates a schematic view of traces routing of a connector in accordance with a first embodiment of the instant disclosure.
Figure 4:
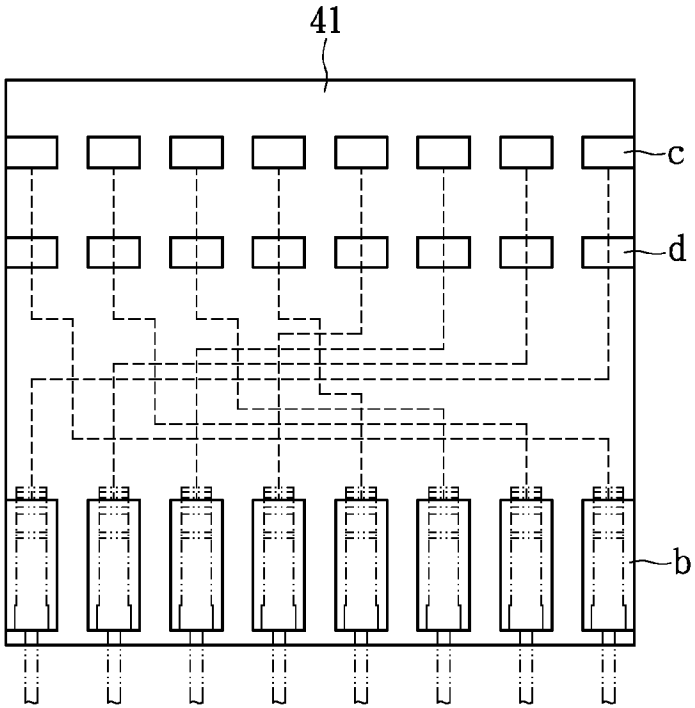
FIG. 4 illustrates a schematic view of alternative-traces routing of a connector in accordance with a first embodiment of the instant disclosure.

The circuit board 41 may further connect to a software driver interface and therefore receive commands from the computer system. The signal transmission and power switch to the connected wire or the circuit board 41 are delivered through alternative routing. As shown in FIG. 4, the connection between the first contacts c and second connection portion b is alternative routing. As shown in FIG. 5, the connection between the second contacts d and second connection portion b is corresponding routing. FIGS. 4 and 5 are exemplary embodiment of the instant disclosure and the connection is not limited thereto.

The circuit unit 4 is movably disposed within the insulating main body 1 so the second contact portion 22 can selectively contact the first, second and third contacts c, d, e while the fourth contact 32 can selectively contact the fourth and fifth contacts f, g so as to perform contact pin switching.

Figure 8:
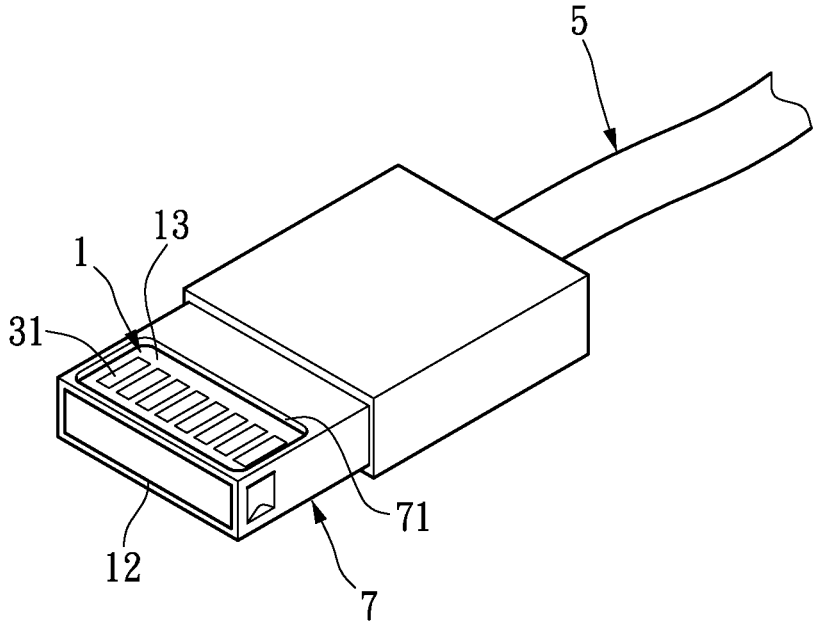
FIG. 8 illustrates a perspective view of a connector in accordance with a fourth embodiment of the instant disclosure.

Attention is now invited to FIG. 8. In the instant embodiment, the insulating main body 1 is coated with a metallic jacket 7. The metallic jacket 7 is formed with two openings 71 which correspond to the first contact portion 21 of the first conductive terminal 2 and the third contact portion 31 of the second conductive terminal 3. Therefore the first and third contact portions 21, 31 are exposed and the remaining body is grounded and protected by the metallic jacket 7.

Figure 9:
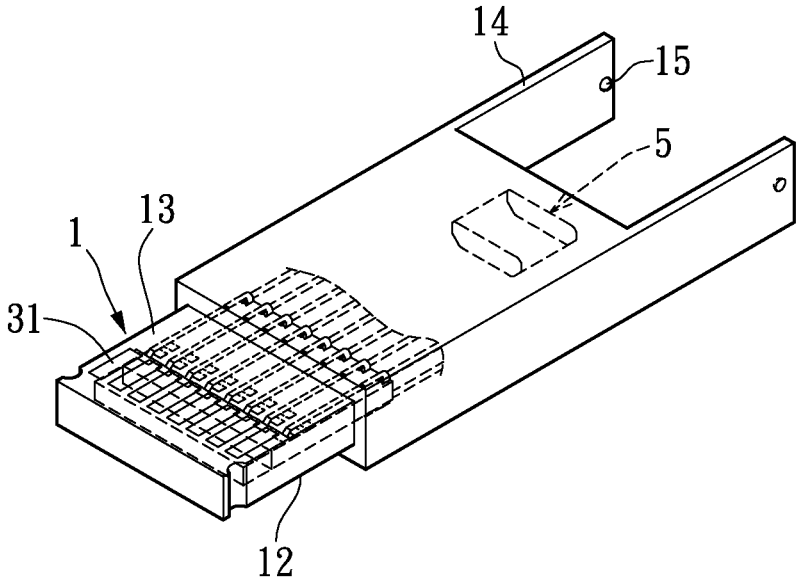
FIG. 9 illustrates a perspective view of a connector in accordance with a fifth embodiment of the instant disclosure.
Figure 10:
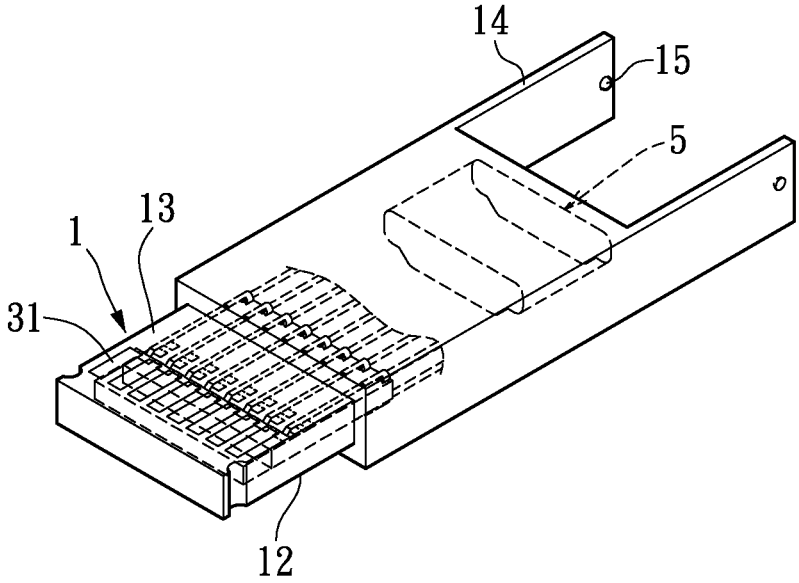
FIG. 10 illustrates a perspective view of a connector in accordance with a sixth embodiment of the instant disclosure.

Attention is now invited to FIGS. 9 and 10. In the instant embodiment, the insulating main body 1 includes two arms 14. The inner faces of the arms 14 have knobs 15 or glide tracks (not shown). The first and second connection portions a, b can connect to other types of electronic device and the arms 14 allow the alternative mechanical coupling. The knobs 15 or glide tracks permit the combination with another electronic device by the corresponding knobs or glide tracks on the latter (electronic device).

The insulating main body provided by the instant embodiment includes a movably mounted circuit unit having a plurality of contacts. The contacts can be alternative, corresponding, partially alternative routing or the like. The specialized routings allows bidirectional plug/receptacle mating. Moreover, the movable circuit unit is not limited to a single contact arrangement.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A bidirectional connector comprising:

a hollow insulating main body having a cavity, a first surface, and a second surface;

a plurality of first conductive terminals mounted on the insulating main body, each of the first conductive terminals including:

a first contact portion exposed on the first surface;

a second contact portion bulging toward the cavity of the insulating main body; and a first connection portion;

a plurality of second conductive terminals mounted on the insulating main body, each of the second conductive terminals including:

a third contact portion exposed on the second surface; and a second connection portion; and a circuit unit movably disposed within the insulating main body, the circuit unit including:

a circuit board;

a top face formed with a plurality of first contacts in alternative routing and a plurality of second contacts, the second contact portion selectively contacting the first and second contacts; and a bottom face.

2. The bidirectional connector according to claim 1, wherein the third contact portion and the first contact portion are mounted on the first and second surface respectively.

3. The bidirectional connector according to claim 1, wherein the second contacts are arranged as corresponding or partially alternative routing.

4. The bidirectional connector according to claim 1, wherein the top face of the circuit board further has a plurality of third contacts in alternative, corresponding or partially alternative routing selectively contacting the second contact portion.

5. The bidirectional connector according to claim 1, wherein each of the second conductive terminals includes a fourth contact portion bulging toward the cavity of the insulating main body and positioned substantially opposite to the second contact portion.

6. The bidirectional connector according to claim 5, wherein the fourth contact portion of the second conductive terminal and the second contact portion of the first conductive terminal are alternatively arranged and the circuit unit is inserted there-between.

7. The bidirectional connector according to claim 5, wherein the bottom face of the circuit bard has a plurality of fourth contacts in alternative routing and a plurality of fifth contacts in corresponding or partially alternative routing.

8. The bidirectional connector according to claim 1, wherein the circuit board has a slide button for pushing the circuit unit within the insulating main body.

9. The bidirectional connector according to claim 1, wherein the insulating main body is covered by a metallic shell.

10. The bidirectional connector according to claim 1, wherein the insulating main body is coated with a metallic jacket having two openings respectively corresponding to the first contact portion of the first conductive terminals and the third contact portion of the second conductive terminals.

11. The bidirectional connector according to claim 1, wherein the first and second conductive terminals are mounted on the insulating main body by insert molding.

12. The bidirectional connector according to claim 1, wherein the first connection portion of the first conductive terminals and the second connection portion of the second conductive terminals are electrically connected to an electronic device.

13. The bidirectional connector according to claim 12, wherein the insulating main body includes two arms having knobs or glide tracks and the electronic device is an electronic connector.

* * * * *